US006050345A

United States Patent [19]

Jarvinen et al.

[11] Patent Number: 6,050,345

[45] Date of Patent: Apr. 18, 2000

[54] ERGONOMIC TOOL WITH LIFT ASSIST MECHANISM

[75] Inventors: Jari P. Jarvinen, Ronkonkoma; Thomas J. Cassar, St. James; Kevin J. Costello, Sea Cliff; Scott A. Valorose, Ronkonkoma, all of N.Y.

[73] Assignee: KeySpan Energy, Hicksville, N.Y.

[21] Appl. No.: 08/805,673

[22] Filed: Feb. 27, 1997

[51] Int. Cl.[7] ..... B25C 3/08

[52] U.S. Cl. ..... 173/31; 173/112; 173/152; 173/162.1; 173/171; 173/186

[58] Field of Search ..... 173/31, 32, 186, 173/162.1, 112, 162.2, 171, 128, 141, 152, 156; 29/81.13, 81.14, 81.15, 81.16

[56] References Cited

U.S. PATENT DOCUMENTS

| | | | |
|---|---|---|---|
| 1,202,551 | 10/1916 | MacKenzie . | |
| 2,165,904 | 7/1939 | Osgood | 173/31 |
| 2,622,312 | 12/1952 | Crisp | 29/81.16 |
| 2,622,562 | 12/1952 | Longenecker . | |
| 2,776,653 | 1/1957 | Eaton . | |
| 2,874,933 | 2/1959 | Feucht . | |
| 3,189,104 | 6/1965 | Jamer et al. | 173/31 |
| 3,369,614 | 2/1968 | Anthony | 173/162.1 |
| 4,402,369 | 9/1983 | Nikitin et al. | 173/31 |
| 4,548,279 | 10/1985 | Zaruba . | |
| 4,986,370 | 1/1991 | Johnson et al. . | |
| 5,095,600 | 3/1992 | Allan | 173/162.2 |
| 5,462,127 | 10/1995 | Svensson | 29/81.16 |
| 5,667,021 | 9/1997 | Bailet et al. | 173/31 |

*Primary Examiner*—Scott A. Smith
*Attorney, Agent, or Firm*—Dilworth & Barrese

[57] ABSTRACT

An ergonomic demolition tool includes a jackhammer and a lift assist mechanism having a wheeled caster assembly. The lift assist mechanism has a frame which is movable between upper and lower positions to provide a lifting force to assist the jackhammer operator in raising the jackhammer.

4 Claims, 12 Drawing Sheets

ERGONOMIC TOOL WITH LIFT ASSIST MECHANISM

BACKGROUND OF THE INVENTION

1. Field of the Invention

The present invention relates to a lift assist type mechanism for use with heavy tools which require manual lifting, for example rotary drills for making holes in the ground, or demolition tools such as jackhammers or rock drills for breaking pavement and the like.

2. Description of the Related Art

Jackhammers are demolition tools commonly used in the construction industry for breaking up pavement such as concrete sidewalks, asphalt roadways, and similar types of working surfaces. Typically, jackhammers are pneumatically driven and have a chisel or other type cutting tool which is repeatedly hammered into the working surface with a reciprocating motion.

Jackhammers can typically weigh as much as 90 pounds. The force required to lift the jackhammer out of a hole can be as high as 300 or more pounds because of the resistance encountered in removing the drill bit from the rubble. Workmen operators performing pavement demolition are generally required to lift the jackhammer to reposition it after completing each portion of the work. Such repeated lifting causes severe stress on the musculoskeletal structure of the human body, resulting in repetitive strain injuries of the shoulders, back, legs, and other parts of the body, which are occupational hazards for such machinery operators. These injuries are painful, and time consuming to treat, with the resultant costs connected with such injuries involving not only the medical cost for treatment, but also down time while the operator recovers.

Lift assist devices for jackhammers are known. For example, U.S. Pat. No. 2,622,562 to Longenecker discloses a detachable lifting jack for fluid actuated tools of the percussive type, such as pavement breakers. The lifting jack includes two telescoping elements: a first one being rigidly affixed to the portable cutting machine, and the second one being slidably connected to the first one and adapted to engage the working surface. Fluid pressure applied to the second element applies force to the working surface which lifts the cutting machine.

U.S. Pat. No. 4,548,279 to Zaruba discloses a demolition tool provided with an extractor for removing the chisel or drill bit from the working surface. The extractor is a piston equipped with a foot which maintains contact with the working surface. When the tool is to be extracted the piston is actuated to press down upon the working surface thereby causing the chisel or drill bit to be forced upward.

While such prior known devices can achieve lifting of the drilling machinery, they suffer from certain disadvantages. First, the operator is still required to lift the jackhammer to move it from place to place. While it may be possible, for example, to pivot the Longenecker apparatus to "walk" the tool to the next location after the chisel has been extracted from the pavement, lifting is still required to overcome the cutting action of the Longenecker pointed tip and the associated friction between the tip and ground. The same is true for the Zaruba extractor. No means are provided to move the entire apparatus to another location without lifting or dragging it to the next work location.

Second, lifting mechanisms in contact with the working surface are subject to very severe bending forces, especially when the machinery is not held perpendicular to the working surface but angled with respect to the vertical direction as, for example, when the machinery is transported to another location. Simple pneumatic cylinders and telescoping pistons do not have sufficient resistance to bending. Accordingly, a need exists for a lift assist device for a demolition tool which is relatively lightweight, portable, easy to use, and which is cost effective.

SUMMARY OF THE INVENTION

An ergonomic demolition tool is provided herein which comprises a jackhammer device and a lift assist mechanism. The jackhammer includes a body, a handle, a reciprocatingly movable elongated drill bit, and means responsive to pneumatic power for operating the drill bit. In a first embodiment, the lift assist mechanism includes a carriage fixedly attached to the jackhammer body, an elongated frame slidably connected to the carriage and moveable between upper and lower positions, the frame being oriented in a direction parallel to the elongated drill bit, a wheeled caster assembly attached to the bottom of the elongated frame, and means associated with the carriage for moving the frame between said upper and lower positions in response to pneumatic power.

In an alternative embodiment the lift assist mechanism includes an elongated pneumatic first cylinder having a piston rod slidably mounted within the axial bore of the cylinder and movable between upper and lower positions. The lift assist mechanism preferably also includes a support shaft extending through the axial bore of at least two mounting fixtures and provides stabilization to inhibit lateral movement of the piston rod. The support shaft and the pneumatic cylinder are oriented parallel to each other and parallel to the orientation of the elongated drill bit of the jackhammer. The support shaft is optionally mounted between the jackhammer body and the cylinder. The piston rod and the support shaft are both connected at their lower ends to a wheeled caster assembly, the piston rod being connected by an eye bolt oriented in such a manner to isolate the piston rod from lateral, or side to side, bending. The support shaft is connected to the wheeled caster assembly by a flange. The pneumatic cylinder and the support shaft are connected to the jackhammer body by the two mounting fixtures.

BRIEF DESCRIPTION OF THE DRAWINGS

Various embodiments are described herein with reference to the drawings, wherein.

DETAILED DESCRIPTION OF PREFERRED EMBODIMENT(S)

The ergonomic demolition tool described herein possesses a lift assist mechanism which facilitates both lifting and moving the demolition tool. Although the demolition tool is described herein as a jackhammer, any such type of heavy powered tool requiring manual operation is contemplated as being within the scope of the present invention. The lift assist mechanism described herein preferably utilizes the jackhammer's pneumatic power source and provides a lifting force of at least about 155 lbs. With an expected tilt of the jackhammer of up to about 30° from vertical during operation, the jackhammer needs to bear up to about 45 lbs side force. Since the jackhammer is expected to be used in tight places it is preferable to avoid additional racks, carriers, or other equipment.

Figure 1:
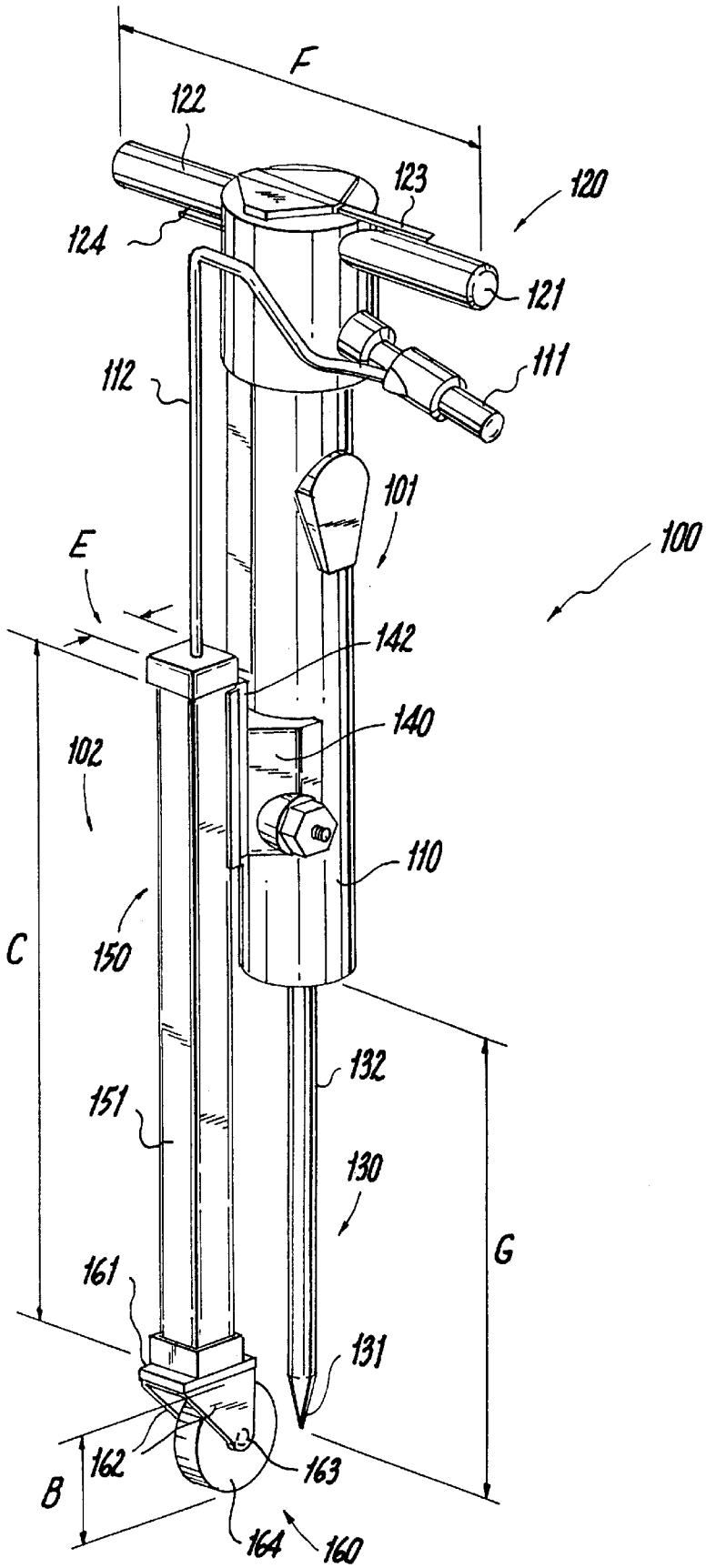
FIG. 1 is a perspective view of a first embodiment of the ergonomic jackhammer of the present invention.
Figure 2:
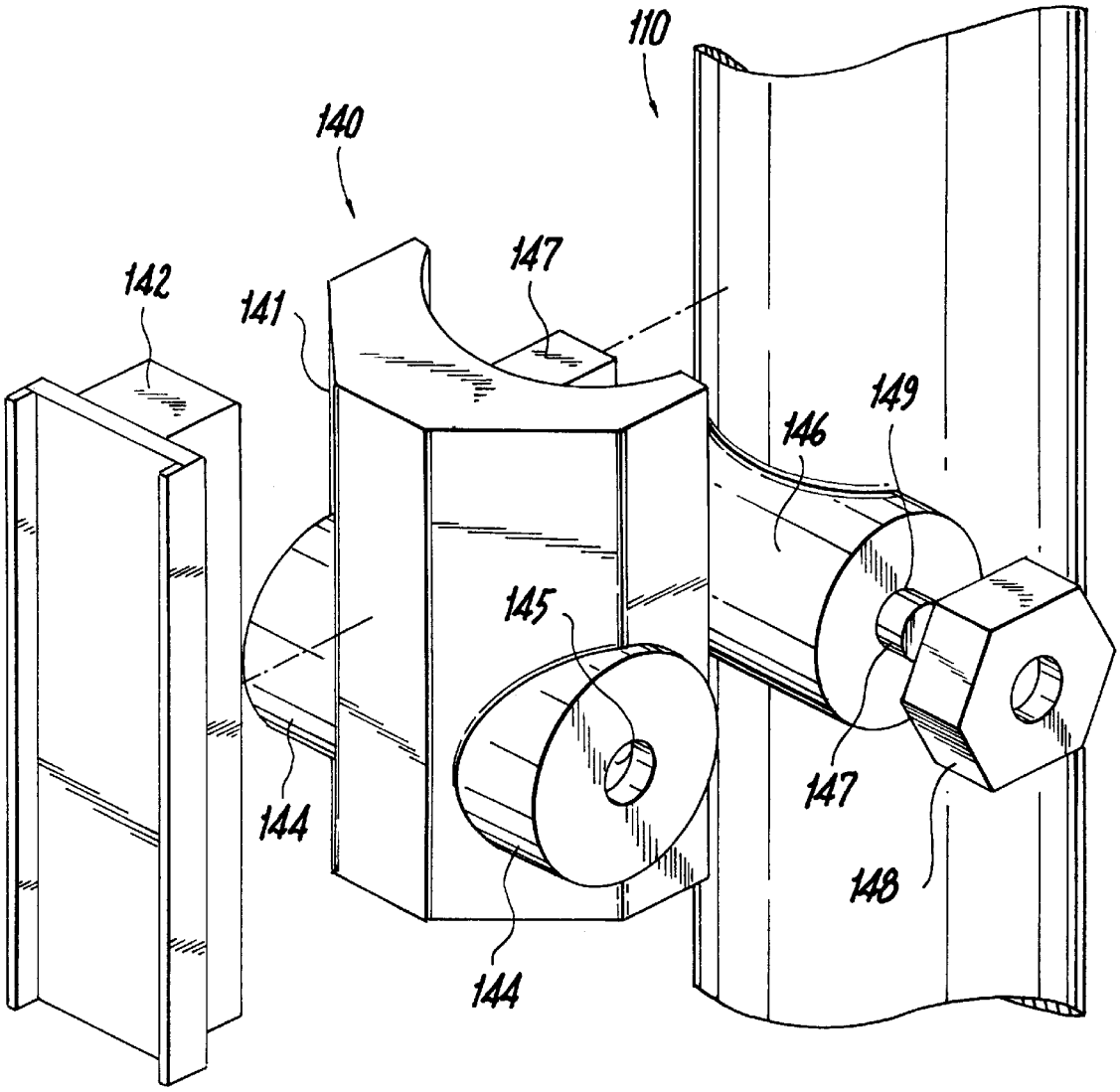
FIG. 2 is an exploded perspective view illustrating the carriage for attachment of the lift assist mechanism to the jackhammer body.
Figure 3:
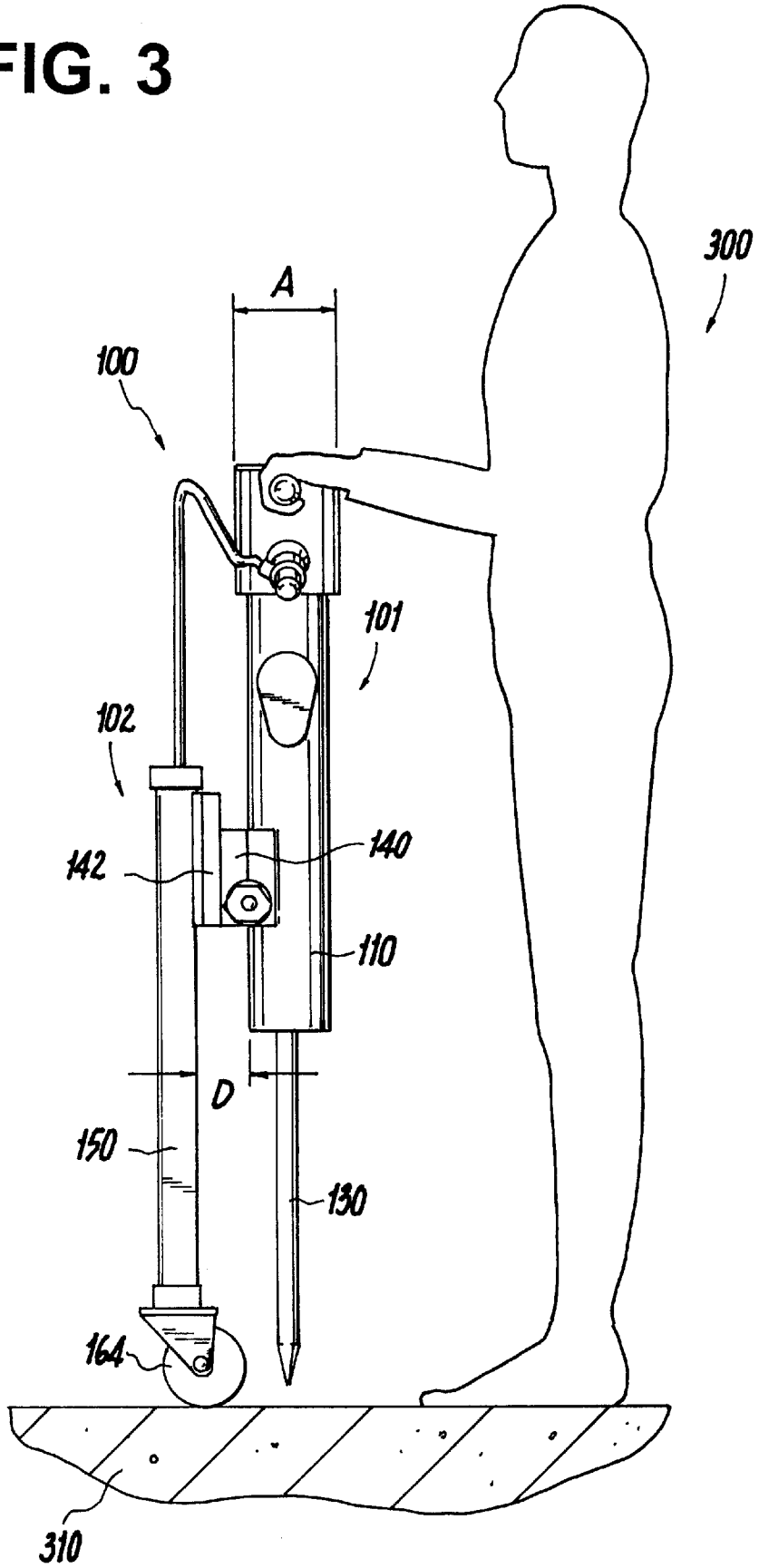
FIGS. 3 and 4 are side views illustrating use of the ergonomic jackhammer for demolition.

Referring to FIGS. 1, 2, and 3, the ergonomic jackhammer 100of the present invention includes a jackhammer device 101 having a lift assist mechanism 102. The jackhammer device 101 includes a jackhammer body 110, handle 120, and chisel or drill bit 130. The lift assist mechanism 102 includes a carriage 142 fixedly attached to jackhammer body 110, a frame 150 which is movably attached to carriage 142, and caster assembly 160 having at least one wheel 164.

The jackhammer body 110 is connected to a pneumatic line 111 which carries compressed gas to power the jackhammer device 101. The jackhammer body 110 includes means responsive to pneumatic power for operating the reciprocatingly movable chisel or other tool for breaking up pavement. Such means are disclosed, for example, in U.S. Pat. Nos. 2,622,562, 4,986,370, 2,874,933, 4,548,279, and 1,202,551, all of which are incorporated by reference herein. Chisel 130 is an elongated member fabricated from a durable metal alloy and comprises a shaft 132 with a tapered end 131. The shaft 132 is mounted to the jackhammer body 110 and is reciprocatingly movable with respect to body 110.

The handle 120 comprises two laterally extending grips 121, 122, and may optionally include one or more appropriately located switches 123 for actuating the jackhammer device 101.

The carriage 142 of the lift assist mechanism 102 is mounted to a mounting fixture 140, which is fixedly attached to the outside of the jackhammer body 110. In one embodiment of the invention frame 150 includes a rodless elongated member 151, which is slidably connected to the carriage 142 and which contains pneumatically powered means for moving frame 150 relative to the carriage 142. Pneumatic power can be drawn off from the main line 111 via line 112, for example, and can be controlled by a switch 124 located in the vicinity of handles 122. Switch 124 can contain a 3-position valve to allow "free floating" of the lift assist mechanism while the jackhammer is being operated, pressurized activation of the lift assist mechanism to provide lift, and a storage configuration in which the lift assist mechanism is retained in a raised position. The frame 150 is movable in a line parallel to the jackhammer body between upper and lower positions in response to the application of pneumatic force. Optionally, a spring can be used to bias the frame in either the upper or lower positions. A locking mechanism can optionally be included to lock the frame in either the upper or lower positions.

Figure 11:
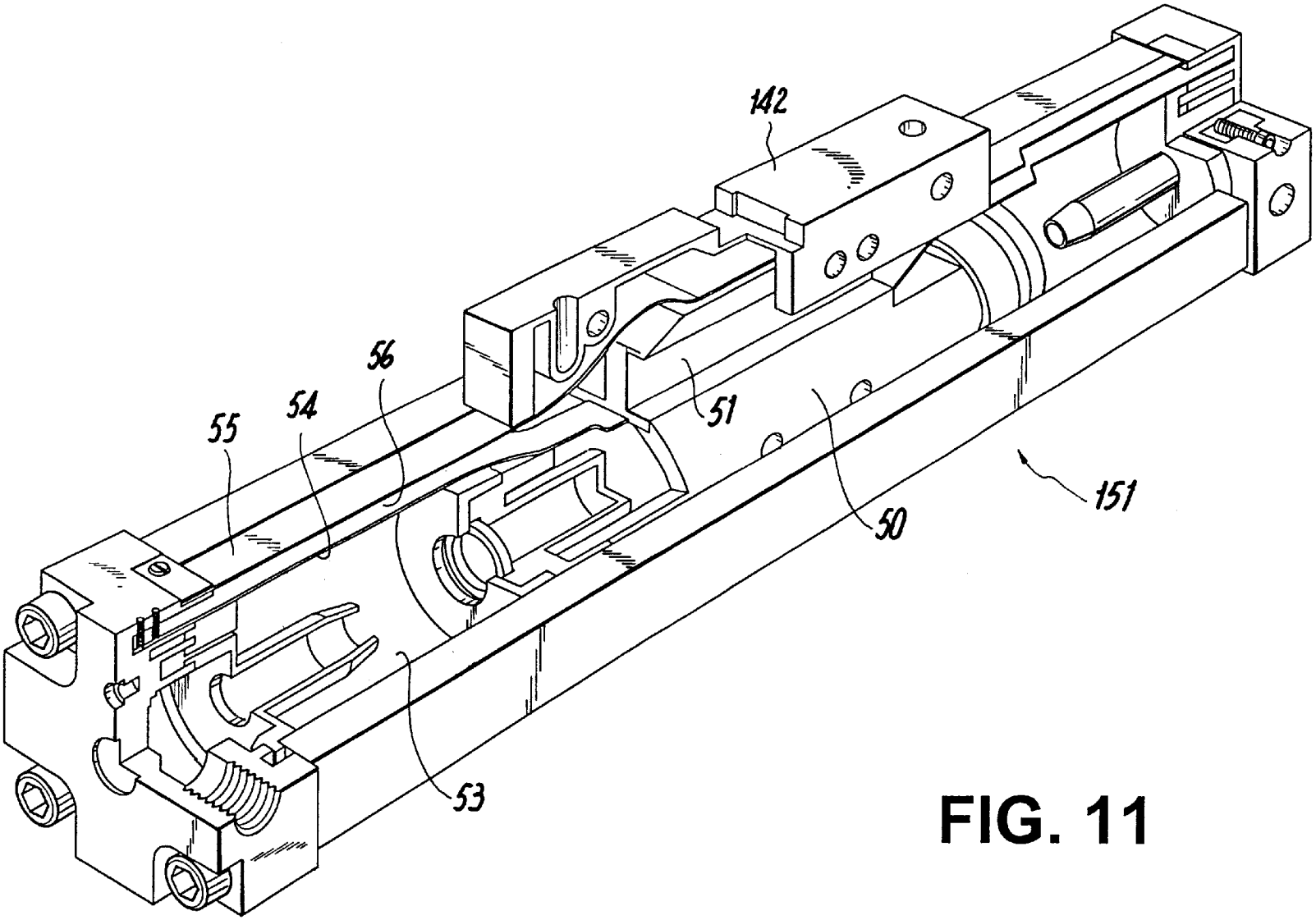
FIG. 11 is a cut-away perspective view of a rodless cylinder for use in the lift assist mechanism for the ergonomic jackhammer of FIGS. 1, and 3–6.

Referring to FIG. 11, the frame 150 includes a piston 50 disposed within a longitudinal bore 53 of rodless elongated member 151. An integral connecting member 51 disposed through an elongated longitudinal slot 56 extending along elongated member 151 provides means for connecting piston 50 with carriage 142 and permits acceptance of external forces and moments, and minimizes frictional losses. The bore 53 of elongated member 151 is preferably eccentric with respect to the outer diameter of the elongated member 151. A flexible, hardened metal band 54 (preferably of stainless steel) runs along the entire length of the bore 53 and passes through piston 50 to provide a metal to metal gaseous seal. An outer band 55 of the same material as inner band 54 acts as a cover over the elongated longitudinal slot 56 to prevent foreign matter from entering the interior of elongated member 151. The piston 50 is preferably fitted with synthetic bearing rings. The lift assist mechanism 102 operates by applying pneumatic pressure to the bore 53 of elongated member 151 on one or the other side of piston 50. Since piston 50 is fixedly mounted to carriage 142 and is stationary with respect to the jackhammer 101, the frame 150 moves up or down with respect to the jackhammer to provide lift assist force. Various bore and stroke lengths may be employed in the lift assist mechanism 102. Also, various types of piston mounting members may be used. A typical operating pressure is about 90 psi. Adjustable cushioning can be provided to facilitate smooth stopping of movement. The lift assist mechanism 102 should be operable in a temperature range of from about 15° F. to about 175° F.

Referring to FIG. 1, caster assembly 160 is attached to the bottom of frame 150 and includes a plate 161 with downwardly extending side supports 162. One or more caster wheels 164 are rotatably mounted to axle 163 which extends between the side supports 162. The caster wheel 164 enables the jackhammer to be easily moved from one location to another by rolling.

The jackhammer device 101 and lift assist mechanism 102 are configured and sized so as to be ergonomically suitable for use by various sized operators. Table I below sets forth dimensions which are suitable for configuring a jackhammer with the lift assist mechanism. The given dimensions as delineated in FIGS. 1 and 3 are illustrative. Other size ranges may also be employed where appropriate.

TABLE I

| Item | Description | Dimension (inches) |
|---|---|---|
| A | Width of jackhammer body 110 | 4–8 |
| B | Diameter of caster wheel 164 | 3–6 |
| C | Height of frame 150 | 25–30 |
| D | Distance between frame 150 and jackhammer body 110 | 1–2 |
| E | Width of frame 150 | 2–4 |
| F | Handle grip spread | 16–20 |
| G | Length of chisel extension | 12–20 |

Referring now to FIG. 2, mounting fixture 140 includes a body 141 having lateral cylindrical extensions 144 with apertures 145. Body 141 is attached to the jackhammer body 110 by fitting the body extensions 144 onto the correspondingly shaped cylindrical projection 146 on the jackhammer body. A nut 148 and a threaded bolt 147 disposed through a lateral bore 149 of lateral projection 146 can be used to secure the mounting fixture body, threaded bolt 147 being disposed through apertures 145 of the extensions 144, and nut 148 being screwed onto the threaded end portion of bolt 147. Carriage 142 is fixedly attached to mounting fixture 140 by any suitable means. The lift assist mechanism 102 can be attached to any side of the jackhammer.

Figure 4:
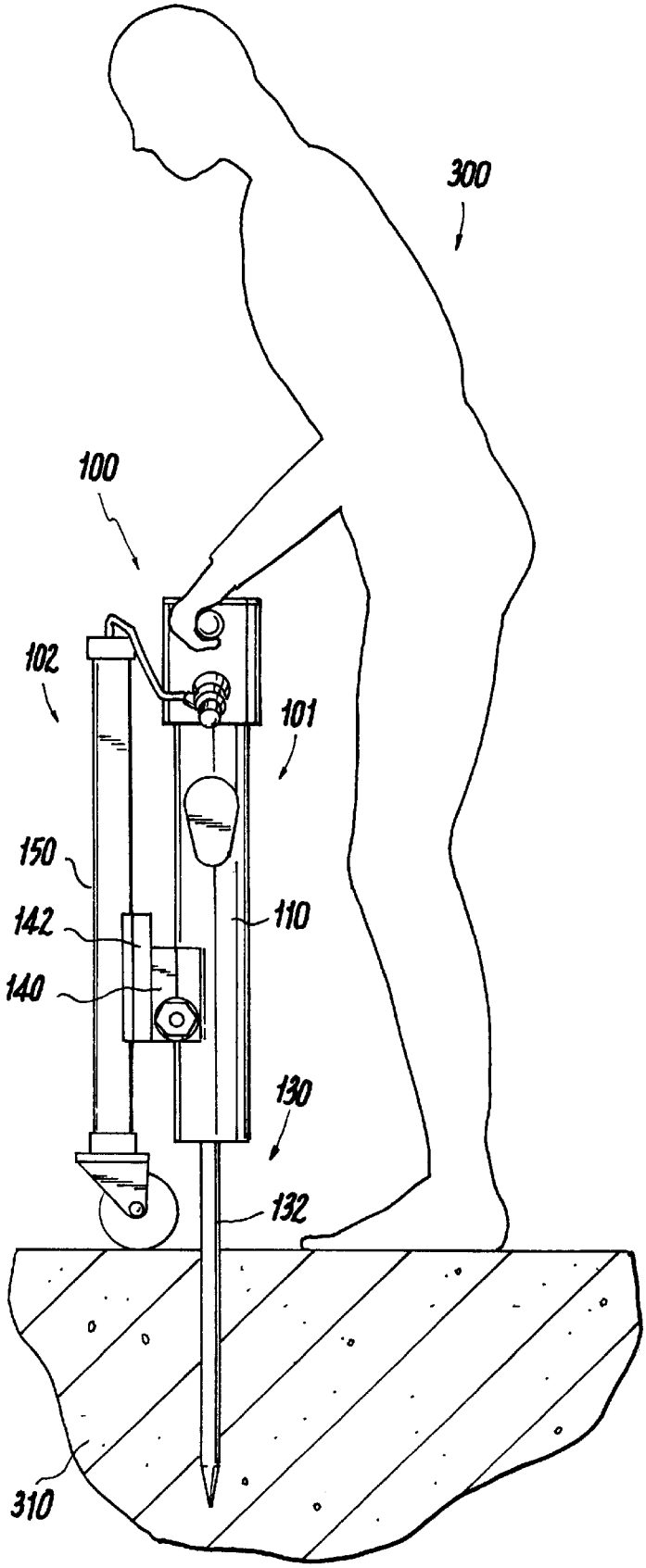

Referring now to FIGS. 3 and 4, the operation of the jackhammer 100 with lift assist mechanism 102 is shown. FIG. 3 illustrates an operator 300 using the jackhammer 100 wherein the frame is initially in the lower position with wheels 164 in contact with the surface. As the chisel 130 digs deeper into the broken pavement 310, the frame 150 is being allowed to slide upward relative to the mounting fixture 140 as the jackhammer 100 digs deeper. (FIG. 4)

Figure 5:
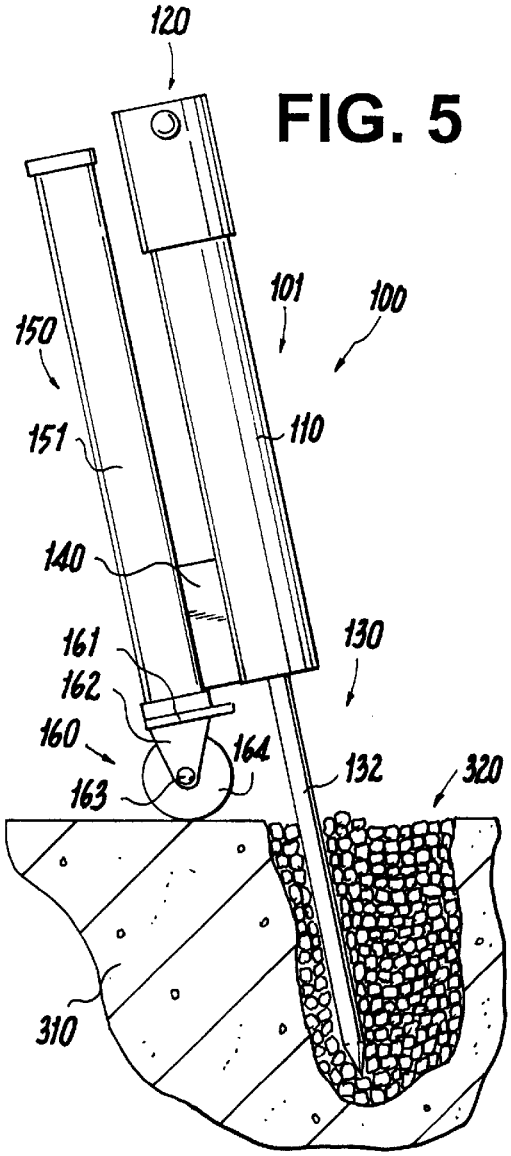
FIGS. 5 and 6 sequentially illustrate use of the lift assist mechanism of the ergonomic jackhammer.
Figure 6:
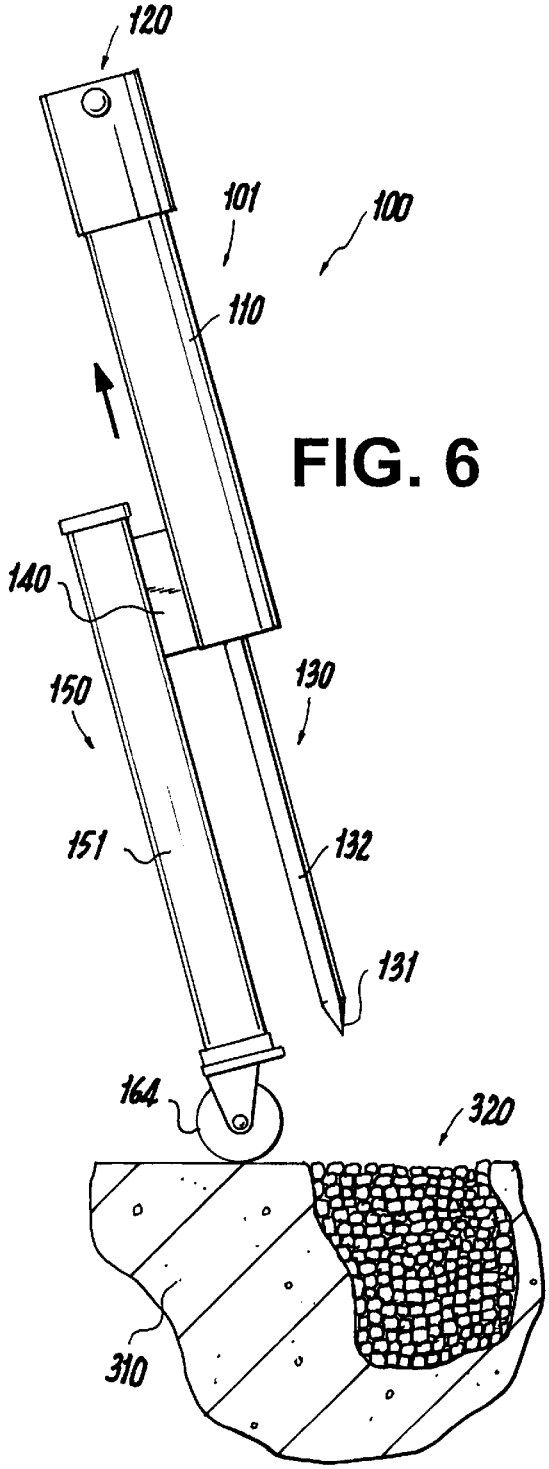

FIGS. 5 and 6 illustrate operation of the lift assist mechanism 102. As can be seen in FIG. 5, the jackhammer device 101 has reached its maximum penetration. The caster wheel 164 is in contact with the surface of the pavement 310. The chisel shaft 132 is in the rubble 320. The jackhammer 100 is now ready to be repositioned at another location. As can be seen in FIG. 6, when the lift assist mechanism 102 is actuated the jackhammer device 101 is mechanically lifted out of the ground as the frame 150 is moved to the lower position relative to the mounting fixture 140. The frame 150 can then be locked in the lower position to facilitate repositioning of the jackhammer 100. The jackhammer can then be rolled to a new location on its wheels 164.

Referring again to FIGS. 3 and 4, the jackhammer 100 can be held in such a manner that the lift assist mechanism 102 is on the side of the jackhammer device 101 opposite that of the operator 300. Alternatively the jackhammer can be held such that the lift assist mechanism 102 is between the jackhammer device 101 and the operator 300, as indicated in FIGS. 5 and 6.

Figure 7:
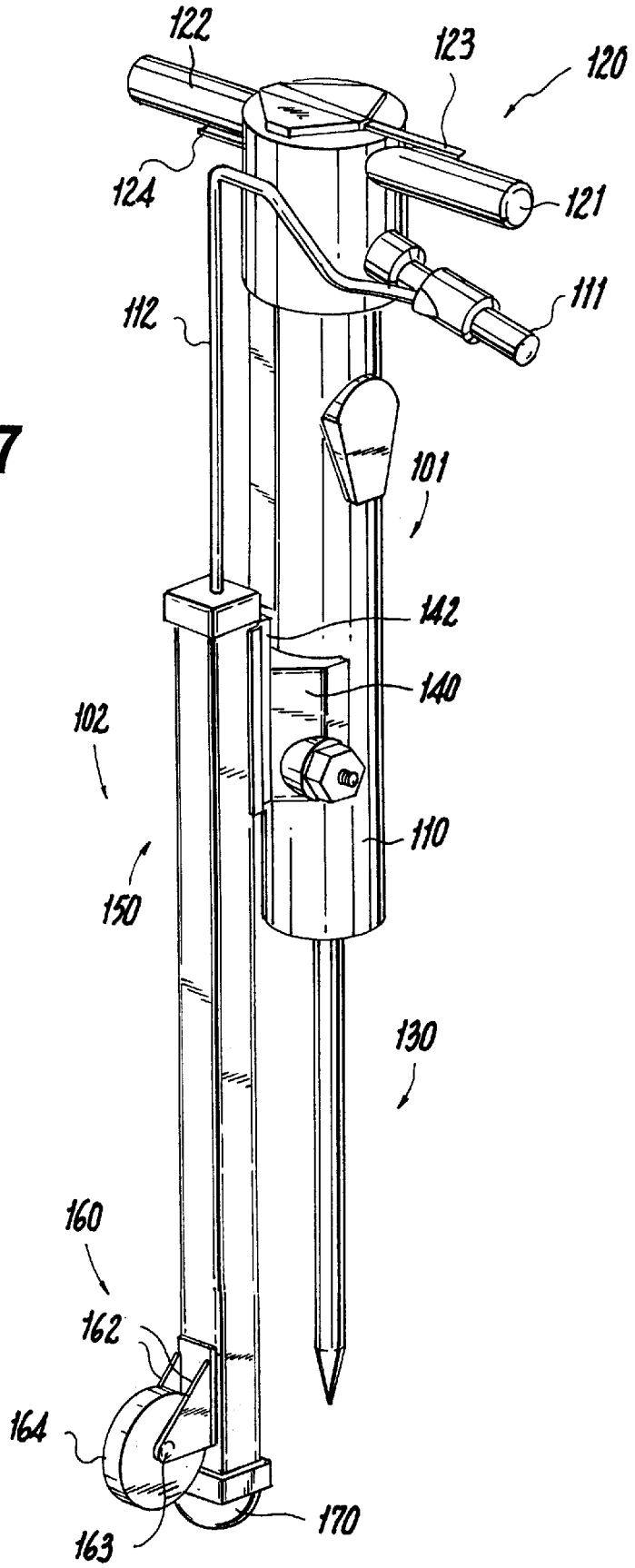
FIG. 7 is a perspective view of an alternative embodiment of the ergonomic jackhammer with a skid stop.

Referring now to FIG. 7, an alternative embodiment of the apparatus is shown in which the caster assembly 160 is mounted to the side of frame 150 such that the caster assembly 160 is in proximity to, but spaced apart from the bottom of frame 150. Wheel 164 does not touch the ground when the jackhammer 100 is held in a vertical upright position. Rather, a footing member having skid stop 170 is mounted to the bottom of frame 150. The skid stop 170 can be made from any material but is preferably a tough, resilient polymeric composition such as neoprene to provide a vibration dampening effect. Skid stop 170 is preferably hemispherical in shape, and provides frictional contact with the ground to inhibit lateral movement of the jackhammer 100 during operation. However, the hemispherical shape of skid stop 170 facilitates the relocation of the jackhammer by enabling sliding or dragging movement along the unbroken pavement. Of course, after demolition is completed, the jackhammer may also be moved by tilting it until the caster wheel 164 contacts the ground. The jackhammer can then be wheeled to a new location.

Figure 14:
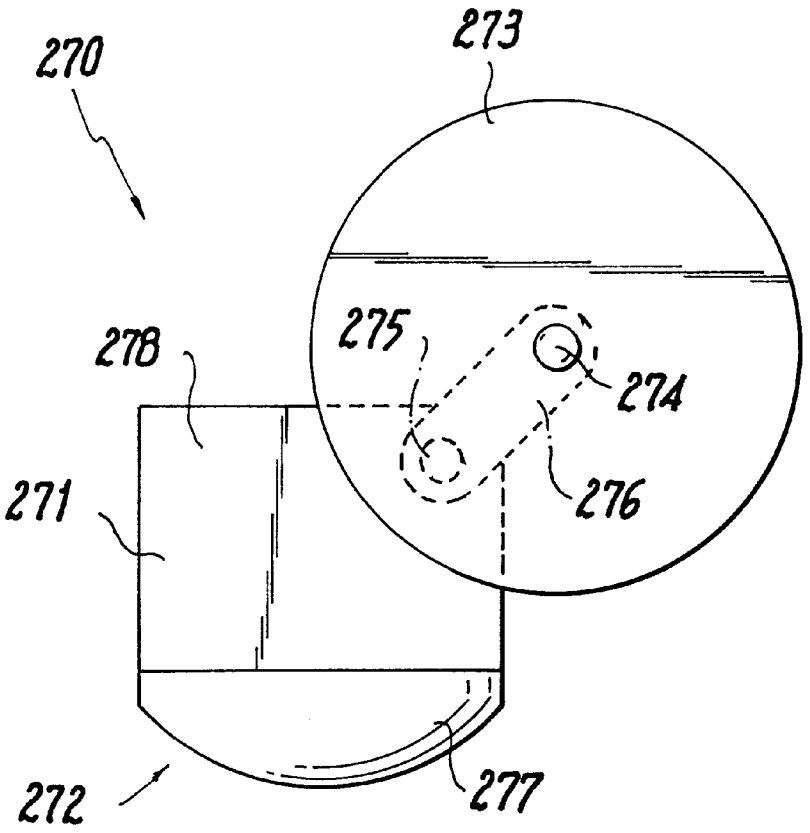
FIGS. 13 and 14 are, respectively front and side elevational views of an alternative embodiment of a footing member.
Figure 13:
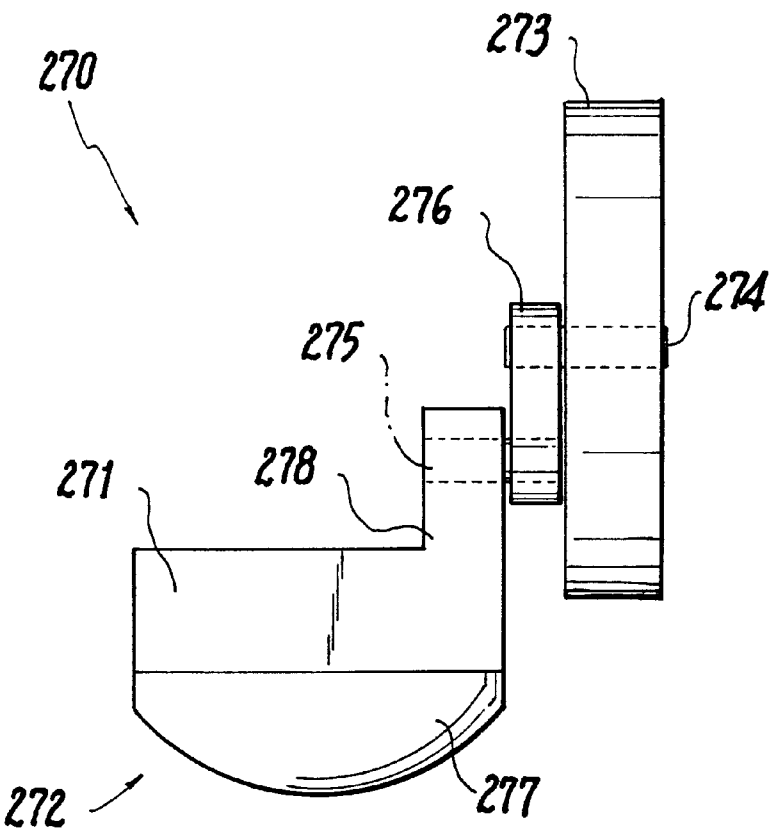

Referring to FIGS. 13 and 14, an alternative footing member is shown wherein footing member 270 includes a body portion 271 and a skid stop 272 fabricated from a material such as that of the above mentioned skid stop 170 with a curved bottom surface 277. Body portion 271 is fixedly attached to the bottom end of the frame of the lift assist mechanism (102 or 202). Elongated link 276 is rotatably attached to a wall 278 of body portion 271 by means of pin 275, which is disposed through the wall of the body 271 and one end portion of the elongated link 276. A caster wheel 273 is rotatably mounted to the other end of elongated link 276 by means of pin 274. Link 276 allows caster wheel 273 to be pivoted by rotation of link 276 around pin 275 between a lower position in which the wheel 273 is in contact with the ground, and an upper position in which the wheel 273 is not in contact with the ground. A locking pin (not shown) or any other suitable means may be used to firmly secure the wheel in a desired position. As can readily be appreciated, the caster wheel can be moved to the lower position to facilitate movement of the jackhammer from one location to another. Caster wheel 273 can be moved to the upper position when the jackhammer is being operated to allow the skid stop 272 to contact the ground and provide vibration dampening function.

Figure 8:
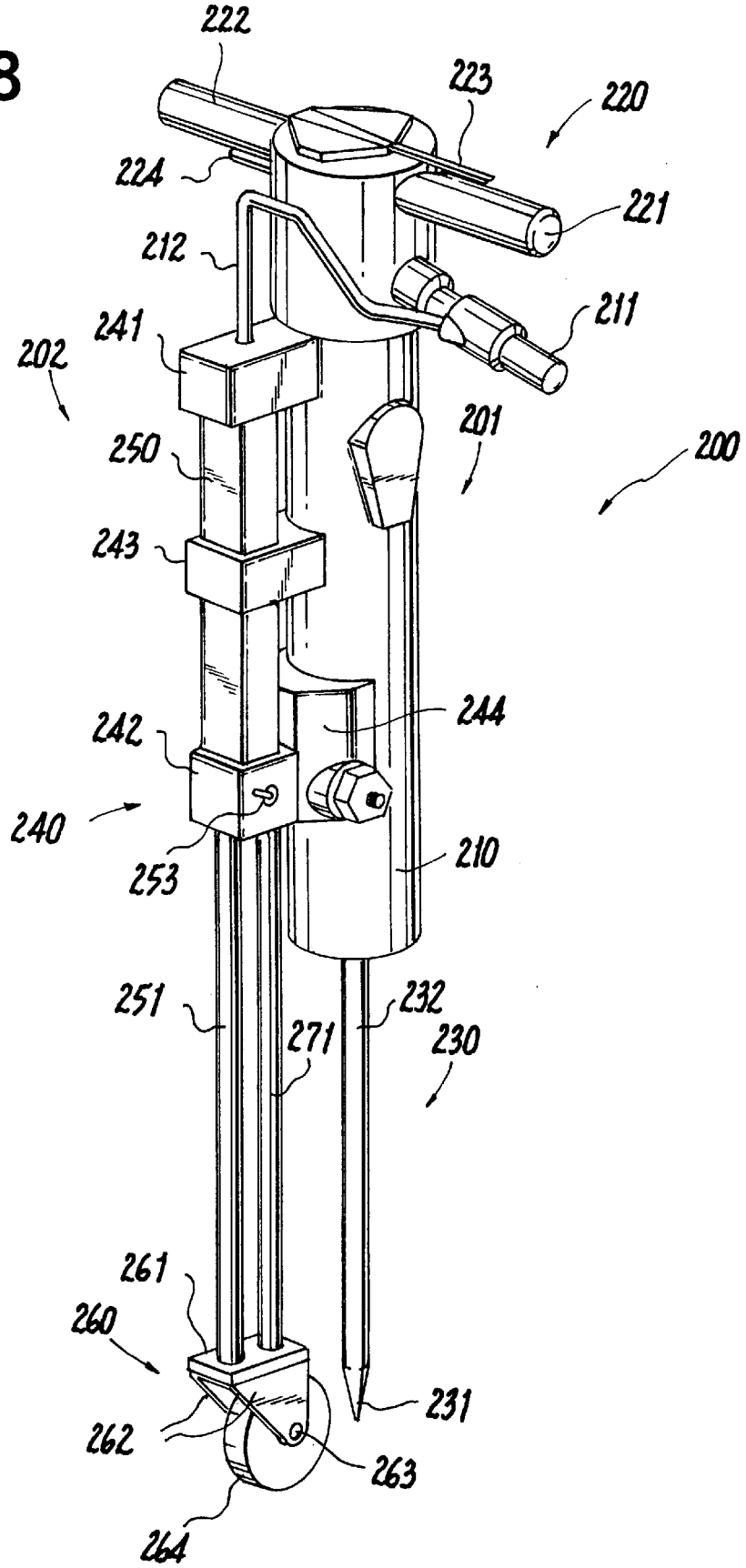
FIGS. 8 and 9 are, respectively, perspective and side elevational views of yet another embodiment of the ergonomic jackhammer employing a piston rod and support shaft.
Figure 9:
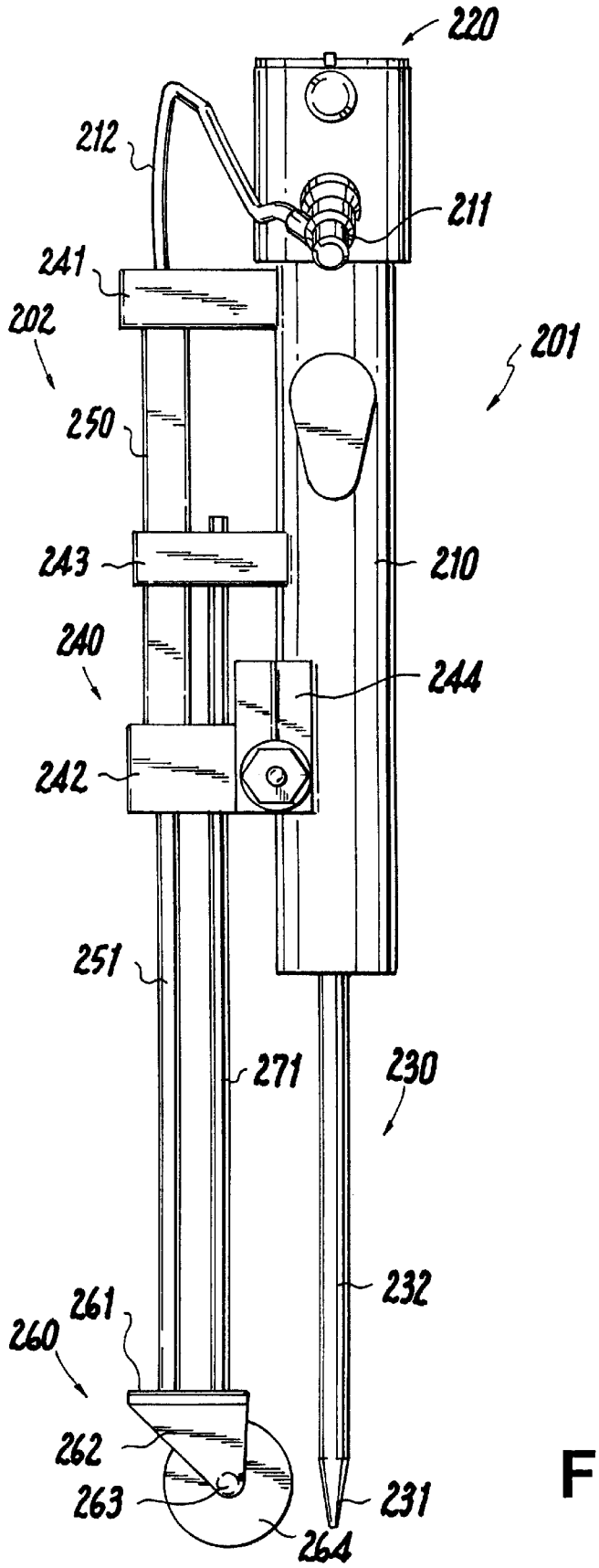

Referring now to FIGS. 8 and 9, an alternative embodiment 200 of the ergonomic jackhammer is shown. Jackhammer 200 includes a jackhammer device 201 having a lift assist mechanism 202. The jackhammer device 201 includes a jackhammer body 210, handle 220, and a chisel or drill bit 230. The lift assist mechanism includes a pneumatically powered cylinder 250 with piston rod 251 slidably mounted thereto, and a separate support shaft 271.

Figure 12:
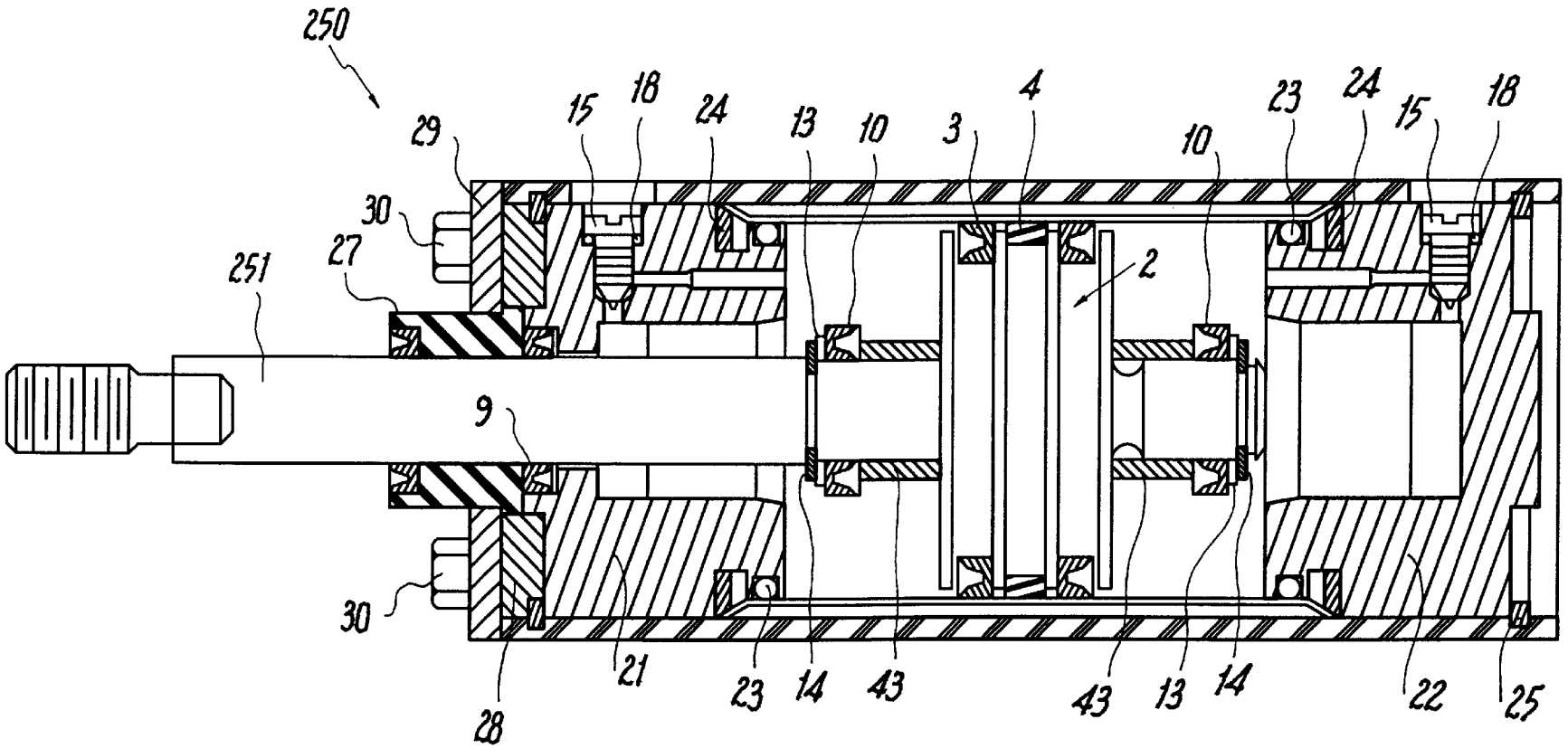
FIG. 12 is a sectional view of a cylinder with rod for use in the lift assist mechanisms for the ergonomic jackhammer of FIGS. 8 and 9.

FIG. 12 illustrates a cylinder 250 suitable for use in the present invention. Cylinder 250 includes an outer tube 19 having an interior space in which the piston 2, piston rod 251, and other components of the cylinder are housed. Tube 19 is capped at one end by retainer plate 29 which is fixed to the tube 19 by means of screws 30. Piston rod 251 is disposed through rod wiper bushing assembly 27 and is attached to piston 2. Rod seal 9 is provided in the rod wiper bushing assembly to provide for sealing contact with rod 251. Piston 2 is slidably disposed within stainless steel body 20 and is longitudinally movable therein. Piston seal 3 and piston bearing ring 4 are circumferentially disposed around piston 2 and provide sealed contact with the inner wall of body 20. Cushion sleeve 43 is disposed around the rod 251 and is capped at distal and proximal ends by cushion seals 10. Cushion washers 13 and cushion retainer rings 14 are attached to the cushion sleeve 43. Cushion retainer rings 14 are disposed within corresponding circumferential grooves in the rod 251. Adjustment screws 15 are provided with O-ring seals 18. Head and cap portions 21 and 22, respectively, are each provided with wave springs 24 and O-ring seals 23. Retainer ring 25 retains the cap portion 22. Member 28 spaces apart the head portion 21 and the retainer plate 29.

Referring to FIGS. 8 and 9, the jackhammer body 210 is connected to a pneumatic line 211 which carries compressed gas to power the jackhammer 200. The jackhammer body 210 includes means responsive to pneumatic power for operating a reciprocating movable drill bit or chisel 230 or other such tool for breaking up pavement. Such means are conventional and known in the art. Chisel 230 is an elongated member fabricated from a durable metal alloy and comprises a shaft 232 with a tapered end 231. The shaft 232 is mounted to the jackhammer body 210 and is reciprocatingly movable with respect to body 210.

The handle 220 comprises two laterally extending grips 221, 222 and may optionally include appropriately located switches for actuating the jackhammer 201. Switch 223 controls pneumatic power delivered to the jackhammer device 201. Switch 224 controls pneumatic power delivered to the lift assist mechanism 202 through line 212.

The lift assist 202 mechanism is attached to jackhammer body 210 by means of at least upper and lower mounting supports 241, 242, respectively. A third mounting supports 243 positioned between supports 241 and 242 is used to support the support shaft 271 when in the lower position. Mounting supports 241, 242, and 243 provide a carriage 240 for the lift assist mechanism 202. Mounting support 242 is fixedly attached to mounting fixture 244, which is preferably mounted to the jackhammer body 210 in a manner similar to that of mounting fixture 140 and jackhammer body 110, as described above.

Pneumatically powered cylinder 250 is mounted to the jackhammer body 210 by means of upper and lower mounting supports 241, 242 and includes a cylindrical axial bore in which piston rod 251 is slidably mounted. Piston rod 251 serves as a movable frame. Both piston rod 251 and support shaft 271 are connected at their lower ends to caster assembly 260, which includes plate 261 with downward extensions 262, and at least one caster wheel 264 rotatably mounted on axle 263 extending between support extensions 262. Optionally, piston rod 251 can terminate at its lower end in a laterally pivotable hinge, i.e. eye bracket 252 (FIG. 10), which is connected to caster assembly 260 by means of a bolt 266 supported by bracket supports 265 and disposed through a bore of the eye bracket 252 in a direction substantially perpendicular to the axis of the jackhammer as defined by the elongated chisel or drill bit 230. The eye bracket 252 isolates the pneumatic cylinder 250 and piston rod 251 from side forces by allowing support shaft 271 to bend from side to side under lateral forces without bending the pneumatic piston rod 251. The pneumatically powered cylinder 250 is oriented parallel to the orientation of the elongated drill bit 230.

Figure 10:
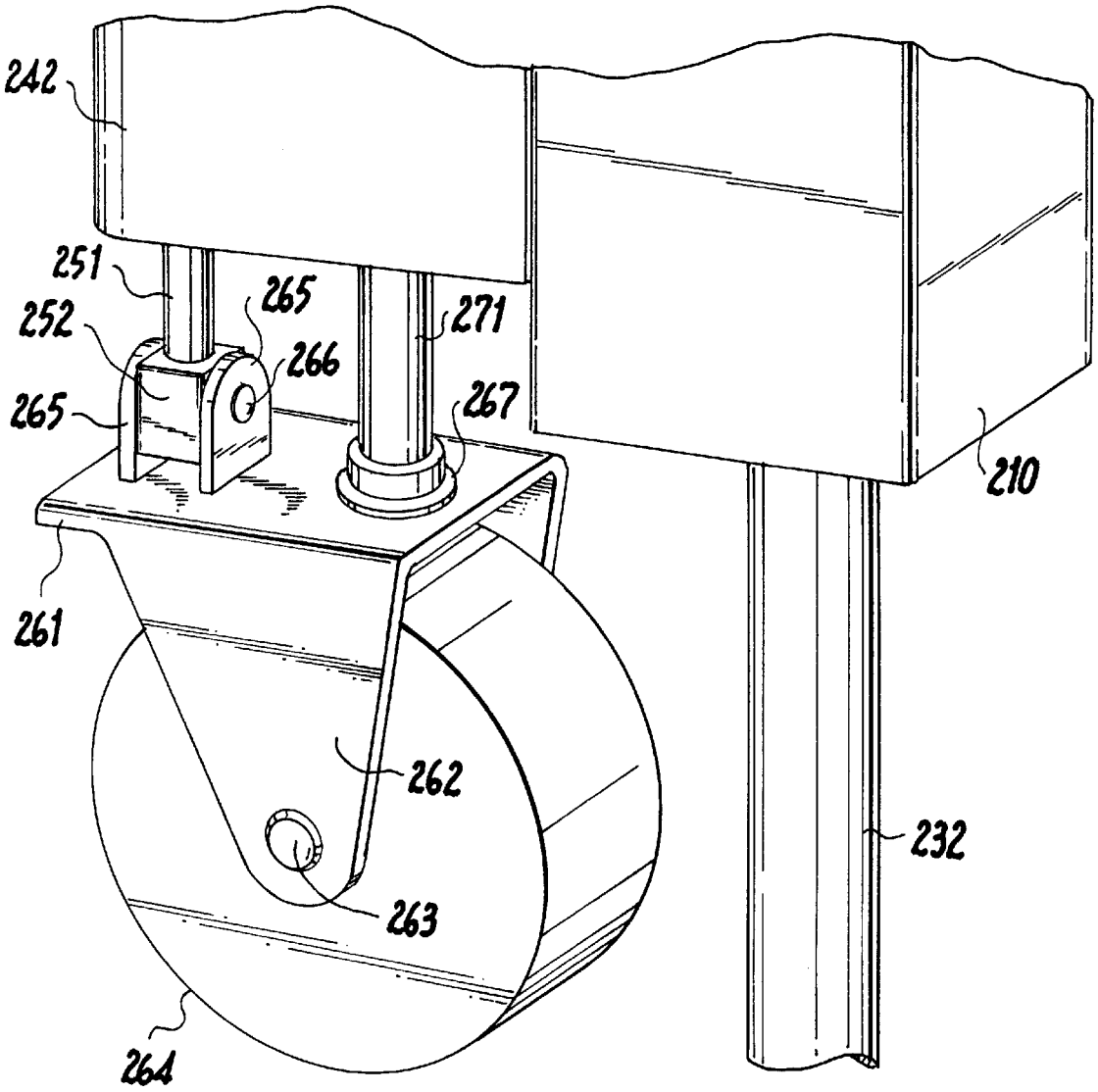
FIG. 10 is a detailed perspective view of the caster assembly of the alternative embodiment of the ergonomic jackhammer of FIGS. 7–9.

Support shaft 271 is slidably mounted between the jackhammer body 210 and pneumatic cylinder 250 by means of the upper, mid, and lower mounting supports 241, 243, and 242, and is oriented parallel to pneumatic cylinder 250 and drill bit 230. The lower end of support shaft 271 is preferably connected to caster assembly 260 by a mounting flange 267 (FIG. 10). Alternatively, two smaller support shafts can be used instead of one support shaft 271 in order to provide greater resistance to torsional forces.

The operation of jackhammer 200 is similar to that of the previously described jackhammer 100. When pneumatic cylinder 250 is actuated, piston rod 251 moves down relative to the cylinder 250, thereby lifting the jackhammer device 201 and facilitating its repositioning to a new location. A locking pin 253 can be used to lock the piston rod 251 in a desired position.

It should be noted that the lift assist mechanisms 102 and 202 advantageously can be manufactured in conjunction with the respective jackhammers 100, 102, or can be separately manufactured and retrofitted to previously manufactured jackhammer devices. Retrofitting permits the already existing supply of jackhammers to be made more ergonomically efficient.

One skilled in the art will understand that various modifications may be made to the above embodiments which are still within the scope and spirit of the invention described herein. For example, the ergonomic tools described herein may optionally be powered by hydraulics or electricity, as well as by pneumatics. Jackhammer 200 can be equipped with a footing member such as hemispherical skid stop 170 in place of or in addition to caster wheel assembly 260. Also, the tools need not be restricted to use in demolition, but can be any type tool in which the lift assist mechanism described herein would be advantageous. Moreover a shield can be included to enclose the lift assist mechanism and protect the workers from moving parts while protecting the lift assist from dust and debris. It should further be noted that by designing tool specific mounting fixtures (e.g. mounting fixtures 140, 244) the same lift assist mechanism can be attached to different tools. Therefore, the above description should not be construed as limiting but merely as exemplifications of preferred embodiments of the invention.

What is claimed is:

1. An ergonomic demolition tool which comprises:

a) a jackhammer having a body, a handle attached to the body, a reciprocatingly movable drill bit, and means for operating said drill bit; and b) a lift assist mechanism which includes, i) a carriage fixedly attached to the body of the jackhammer, ii) an elongated frame having a longitudinal axis, the carriage being slidably attached to the elongated frame and movable between upper and lower positions along the longitudinal axis of the elongated frame, the frame longitudinal axis being parallel to the longitudinal axis of the drill bit, iii) a wheeled caster assembly attached to a side of the elongated frame, iv) means associated with the carriage for moving the carriage along the elongated frame between said upper and lower positions, and v) a stabilizing member including a skid limiting member positioned at a bottom end of the elongated frame to inhibit lateral movement of the frame.

2. The ergonomic demolition tool of claim 1 wherein said means for operating said drill bit and said means for moving the carriage along the elongated frame are both responsive to pneumatic power.

3. In a demolition tool assembly including a jackhammer having a body, a handle attached to the body, a reciprocating drill bit, and a switch for operating the drill bit, the improvement which comprises:

a carriage attached to the jackhammer body, an elongated frame having a longitudinal axis, the carriage being slidably attached to the elongated frame and movable between a first position and a second position along the longitudinal axis of the frame, and a transport assembly secured to a side of the elongated frame adjacent the drill bit, the transport assembly including a wheeled caster assembly, the wheeled caster assembly facilitating movement of the demolition tool assembly from a first location to a second location; and a skid limiting member positioned at a bottom end of the frame to inhibit lateral movement of the elongated frame.

4. The improvement of claim 3, wherein the skid limiting member comprises a hemispherical footing member which facilitates sliding movement of the demolition tool assembly.

* * * * *